United States Patent [19]

Ohbayashi et al.

[11] Patent Number: 4,563,406

[45] Date of Patent: Jan. 7, 1986

[54] LIGHT-SENSITIVE SILVER HALIDE PHOTOGRAPHIC MATERIAL WITH WHITE LAYER AND COLORANT CONTAINING LAYER

[75] Inventors: Keiji Ohbayashi; Kaoru Onodera, both of Odawara, Japan

[73] Assignee: Konishiroku Photo Industry Co., Ltd., Tokyo, Japan

[21] Appl. No.: 630,333

[22] Filed: Jul. 12, 1984

Related U.S. Application Data

[63] Continuation of Ser. No. 424,273, Sep. 27, 1982, abandoned.

[30] Foreign Application Priority Data

Oct. 7, 1981 [JP] Japan ..... 56-160747

[51] Int. Cl.[4] ..... G03C 1/84

[52] U.S. Cl. ..... 430/513; 430/510; 430/517; 430/593

[58] Field of Search ..... 430/513, 517, 518, 537, 430/538, 593

[56] References Cited

U.S. PATENT DOCUMENTS

| | | | |
|---|---|---|---|
| 2,921,914 | 1/1969 | Pechmann | 430/513 |
| 3,449,122 | 6/1969 | Kretchman et al. | 430/517 |
| 3,996,050 | 12/1976 | Land | 430/517 |
| 4,078,933 | 3/1978 | Sugiyama et al. | 430/518 |
| 4,237,206 | 12/1980 | Fujita | 430/538 |
| 4,296,198 | 10/1981 | Trautweiler | 430/538 |
| 4,355,099 | 10/1982 | Trautweiler | 430/537 |

*Primary Examiner*—Jack P. Brammer

*Attorney, Agent, or Firm*—Frishauf, Holtz, Goodman & Woodward

[57] ABSTRACT

There is disclosed a light-sensitive silver halide photographic material having a white pigment containing layer and at least one silver halide emulsion layer provided successively on a support, being characterized in that there is provided a colorant containing layer capable of being made substantially colorless by a photographic treatment between said support and said white pigment containing layer. The present invention provides a light-sensitive silver halide photographic material having a reflective support improved to a great extent in sharpness substantially without bringing about lowering in sensitivity.

10 Claims, No Drawings

LIGHT-SENSITIVE SILVER HALIDE PHOTOGRAPHIC MATERIAL WITH WHITE LAYER AND COLORANT CONTAINING LAYER

This application is a continuation of application Ser. No. 424,273, filed Sept. 27, 1982, now abandoned.

This invention relates to a light-sensitive silver halide photographic material, particularly to a light-sensitive silver halide photographic material having a reflective support and having improved sharpness.

As the factors influencing the sharpness of a light-sensitive silver halide photographic material, there have been known generally irradiation and halation. The former is brought about by scattering of the incident light caused by silver halide grains and oil droplets such as of couplers dispersed in a gelatin film, and is dependent primarily on the gelatin content, the silver halide content and the oil droplet content. In contrast, the latter is dependent on the extent of light reflection from the support, namely on the reflectance and the refractive index of the support.

Whereas, in a light-sensitive silver halide photographic material having a reflective support such as in black-and-white printing paper or color printing paper, halation contributes overwhelmingly more to sharpness than irradiation, because the support has a high reflectance. For improvement of sharpness, it is therefore most effective to shield the light reflected from the support. For this purpose, it has been practiced to provide a halation prevention layer between a reflective layer containing a white pigment and a silver halide emulsion layer, thereby shielding the light reflected from the reflective layer again into the silver halide emulsion layer or to add a irradiation prevention dye into the emulsion layer, thereby attenuating the light reflected from the reflective layer.

However, such improved techniques, while they may be useful for improvement of sharpness, suffer from the drawback of lowering to a great extent the effective sensitivity of a light-sensitive silver halide photographic material. Thus, it has been almost impossible in a conventional light-sensitive silver halide photographic material having a reflective support to achieve both sharpness and high sensitivity.

An object of the present invention is to overcome the above drawback and provide a light-sensitive silver halide photographic material having a reflective support improved to a great extent in sharpness substantially without bringing about lowering in sensitivity.

The above object of the present invention can be accomplished by a light-sensitive silver halide photographic material having a white pigment containing layer and at least one silver halide emulsion layer provided successively on a support, being characterized in that there is provided a colorant containing layer capable of being made substantially colorless by a photographic treatment between said support and said white pigment containing layer. By "substantially colorless" is meant that coloration to an extent as will not impair the whiteness of the white pigment containing layer may be permissible.

The white pigment containing layer to be used in the present invention is positioned on the side of than the colorant containing layer away from the support, and the white pigment containing layer is required to be permeable to a treating solution, because the colorant containing layer is made substantially colorless by the photographic treatment.

As the white pigment, there may be employed, for example, titanium dioxide, barium sulfate, zinc oxide, barium, stearate, silica, alumina, zirconium oxide, kaolin, etc. For various reasons, however, titanium dioxide is above all preferred. The white pigment is dispersed in a water soluble binder of a hydrophilic colloid such as gelatin through which a treating solution can be permeated. In this case, the white pigment is required to be used in an amount enough to maintain the whiteness when viewing a light-sensitive silver halide photographic material. When titanium dioxide is used as the preferable white pigment and a transparent base is used as the support, titanium dioxide required is in the range from 10 to 50 $g/m^2$, particularly preferably in the range from 15 to 35 $g/m^2$.

As the light absorptive substance to be used in the colorant containing layer to be used in the present invention (hereinafter referred to merely as the colorant containing layer), there may be employed yellow, gray and blue colloid silver and also various known filter dyes. As such a light absorptive substance, it is possible to select as desired either a substance capable of absorbing the light in the entire visible spectral region or a substance capable of absorbing the light selectively at only a part of the region.

The colorant containing layer has a transmittance of 50% or less, preferably 30% or less.

The filter dye to be used in the present invention is not limited, so long as it can be dissolved out or decolored during the photographic treatment. It is preferred, however, to use an acidic dye having sulfonyl groups or carboxyl groups in the molecules, as exemplified by azo type, triphenylmethane type, anthraquinone type, styryl type, benzylidene type, melocyanine type, oxonol type and other acidic dyes.

Such dyes are disclosed in the respective specifications of Japanese Patent Publication Nos. 22069/1964, 13168/1968, 42667/1971, 42668/1971, 6207/1974, 10058/1980, 10061/1980, 10059/1980, 10060/1980 and 100187/1980, Japanese Provisional Patent Publication Nos. 117123/1977 and 128125/1977. More specifically, the following compounds may be mentioned.

(F-1)

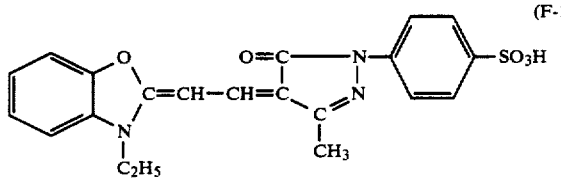

(F-2)

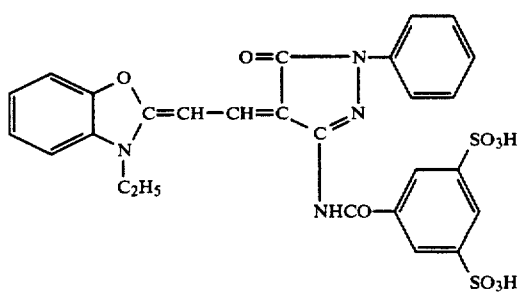

-continued (F-3)

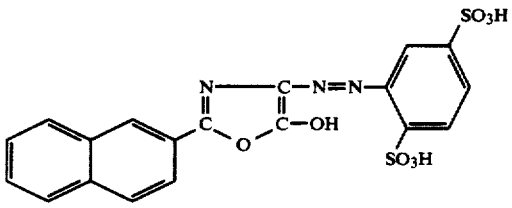

(F-4)

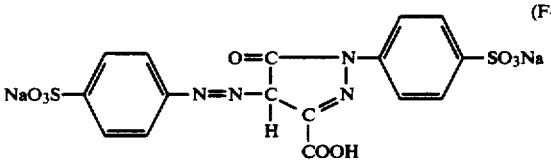

(F-5)

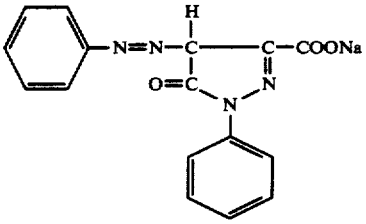

(F-6)

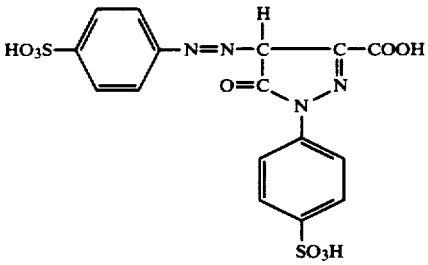

(F-7)

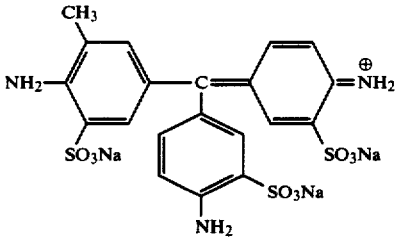

(F-8)

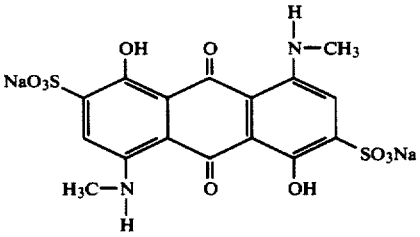

(F-9)

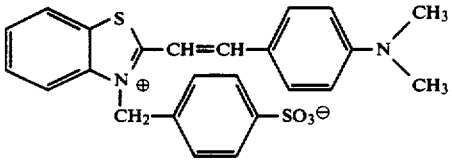

-continued (F-10)

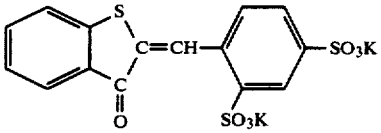

(F-11)

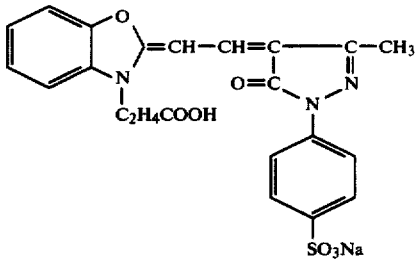

(F-12)

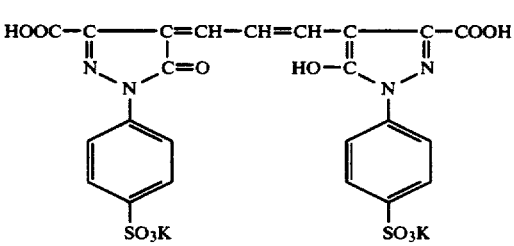

(F-13)

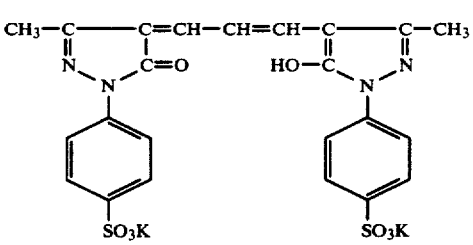

(F-14)

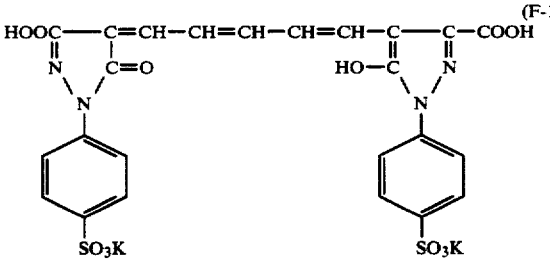

(F-15)

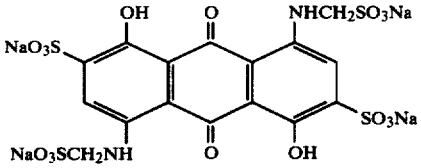

These filter dyes may be used either singly or in combination with other filter dyes or yellow, gray and blue colloidal silver. When a filter dye is used in the colorant containing layer, it is preferred to use a mordant to prevent reduction of the effect of the present invention through diffusion of the filter dye to other layers. As such mordants, there may be employed macromolecular mordants having basic groups, including, for example, polymers containing imidazole, pyridine, alkylaminoalkyl (meth)acrylate, or quaternary salts thereof, aminoguanidine, etc. These mordants may be those as disclosed in U.S. Pat. Nos. 2,548,564; 2,675,316; 2,882,156; and 3,706,563.

When yellow, gray and blue colloidal silvers are used in the colorant containing layer, these colloidal silvers are generally removed in the step of bleaching or fixing (or bleach-fixing), and the filter dye is dissolved out from the light-sensitive silver halide photographic material in any of the steps of developing, bleaching, fixing (or bleach-fixing, or washing with water) or decolored with a sulfite as disclosed in U.K. Pat. No. 506,386.

In the present invention, the colorant containing layer may be provided between the support and the white pigment containing layer, and there may also optionally be provided intermediary layers between these respective layers. Further, there may also be provided a subbing layer between said support and said colorant containing layer.

As specific embodiments, the following layers may be provided successively on the support.

Embodiment—1: Support/Colorant containing layer/White pigment containing layer/Silver halide emulsion layer/Protective layer Embodiment—2: Support/Subbing layer/Colorant containing layer/Intermediary layer/White pigment containing layer/Intermediary layer/Silver halide emulsion layer/Protective layer Embodiment—3: Support/Subbing layer/Colorant containing layer/White pigment containing layer/Intermediary layer/Yellow image forming blue-sensitive silver halide emulsion layer/Intermediary layer/-Magenta image forming green-sensitive silver halide emulsion layer/Intermediary layer/Cyan image forming red-sensitive silver halide emulsion layer/Protective layer.

The light to be absorbed by the colorant containing layer is required to have the same spectral region as the color sensitivity of the silver halide emulsion layer of which sharpness is to be improved. However, when the color sensitivity of the light-sensitive silver halide emulsion layer covers the whole spectral region, as in conventional color photographic material shown in the aforesaid Embodiment—3, the light to be absorbed by the colorant containing layer does not necessarily cover all of the whole spectral region, but it may be a specific light, for example, the light corresponding to the color sensitivity of the silver halide emulsion layer for forming the magenta dye image which is visually most prominent.

The silver halide emulsion to be used in the present invention is not particularly limited, but any one known in the art may be used depending on uses and purposes. For example, all kinds of silver halides such as silver chloride, silver bromide, silver iodide, silver iodobromide, silver chloroiodide, silver chlorobromide, silver chloroiodobromide, etc. may be used as the photosensitive component. It is also possible to subject such a silver halide photographic emulsion to various chemical sensitizations, as exemplified by a noble metal sensitization with a noble metal salt of ruthenium, rhodium, iridium, platinum, gold, etc. such as ammoniumchloropalladate, potassiumchloroplatinate, potassiumchloropalladite, potassiumchloroaurate, etc.; sulfur sensitization with a sulphur compound and active gelatin; reducing sensitization with a stannous salt, a polyamine, etc.; and sensitization with a polyalkyleneoxide group compound.

The silver halide emulsion of the present invention may also be applied with an optical sensitization at any desired spectral region. As the optical sensitizers to be used for such a purpose, there may be included cyanines, melocyanines, trinucleus or tetranucleus melocyanines, trinucleus or tetnucleus cyanines, styryls, holopolar cyanines, hemicyanines, oxonols and hemioxonols. These optical sensitizers may preferably contain as a nitrogen containing heterocyclic nucleus in a part of the structure thereof a basic group such as thiazoline, thiazole, etc. or a nucleus such as rhodanine, thiohydantoin, oxazolidinedione, barbituric acid, thiobarbituric acid, pyrazolone, etc. Such a nucleus may also be substituted with alkyl, hydroxyalkyl, halogen, phenyl, cyano, alkoxy, etc. and optionally be fused with a carbocyclic ring or a heterocyclic ring.

When the light-sensitive silver halide photographic material is used as an ordinary color light-sensitive material, it is usually practiced to add a nondiffusive coupler in the silver halide emulsion layer and/or the adjacent layers thereof. As such couplers, there may be employed known couplers for photography such as open-chain $\beta$-ketomethylene group compounds, pyrazolone group compounds, indazolone group compounds, pyrazolotriazole group compounds, pyrazolobenzimidazole group compounds, phenol group compounds and $\alpha$-naphthol group compounds.

As the binder for formation of the constituent layers of the present invention, gelatin may preferably be used. Other than gelatin, it is also possible to use in part gelatin derivatives such as phthalated gelatin, phenylcarbamoyl gelatin, etc., albumin, agar, gum arabic, alginic acid, casein, partially hydrolyzed cellulose derivatives, partially hydrolyzed polyvinyl acetate, polyacrylamide, polyvinyl pyrrolidone or copolymers of these vinyl compounds. In the hardened binder film primarily composed of gelatin, there may be used known hardeners conventionally used for hardening of the gelatin films of light-sensitive silver halide photographic materials, as exemplified by organic hardeners such as epoxy type hardeners, ethyleneimino type hardeners, aldehyde type hardeners, active vinyl type hardeners, halo-substituted S-triazine type hardeners, or inorganic hardeners such as aluminum salts, chromium salts, zirconium salts, etc.

Further, there may also be employed in the present invention known additives for photography such as emulsion stabilizers, activating agents, thickners, development accelerators, image stabilizers, stain preventives, etc. As typical examples, there may be mentioned those as disclosed in Research Disclosure No. 17643 and No. 18716.

As the support to be used in the present invention, there may be used nitrocellulose films, acetylcellulose films, polyvinyl acetal films, polycarbonate films, polystyrene films, polyethyleneterephthalate films, papers and polymer-coated papers coated with polyethylene, etc. Either transparent or intransparent material may be used as the support. However, in case of an intransparent support, it is preferred to be a white intransparent support.

The present invention is described in further detail by referring to the following Examples, by which however the present invention is not limited.

EXAMPLE 1

On a polyethylene resin coated paper, the layers shown below were coated successively to prepare a light-sensitive black- and white silver halide photographic material (Sample 1) (Note: In all of the following Examples, the amounts added in light-sensitive silver halide photographic materials are shown per 1 $m^2$, and the silver halide emulsions and colloidal silvers are calculated as silver);

Layer 1: Colorant containing layer containing 20 mg of (F-6) as a filter dye, 80 mg of a basic mordant (M-1) having the formula shown below as a mordant and 0.85 g of gelatin;

Layer 2: White pigment containing layer containing 1.5 g of gelatin having dispersed 15 g of anatase type titanium dioxide (W-10; produced by Ishihara Sangyo Co., Ltd.);

Layer 3: Intermediary layer containing 0.9 g of gelatin;

Layer 4: Blue-sensitive emulsion layer containing 1.4 g of a blue-sensitive silver chlorobromide and 1.6 g of gelatin;

Layer 5: Protective layer containing 0.7 g of gelatin

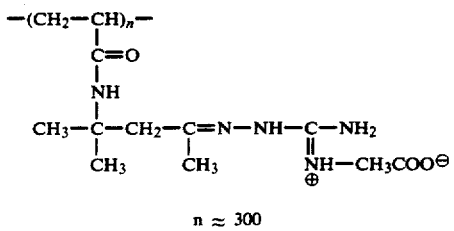

(M-1)

n ≈ 300

On the other hand, as comparative samples, there were prepared a sample in which none of the filter dye and the mordant were employed in Layer 1 (Sample 2) and a sample in which none of the filter dye and the mordant were employed in Layer 1, but the same amounts of the filter dye and the mordant as used in Layer 1 were used in Layer 3 (Sample 3).

Further, as comparative samples having conventional constitutions, there were prepared Sample 4 and Sample 5 having the layers as shown below on a polyethylene resin coated paper containing anatase type titanium dioxide in polyethylene:

(Sample 4)

Layer 1: the same as Layer 4 in Sample 1
Layer 2: the same as Layer 5 in Sample 1

(Sample 5)

Layer 1: the same as Layer 1 in Sample 1
Layer 2: the same as Layer 3 in Sample 1
Layer 1: the same as Layer 4 in Sample 1
Layer 2: the same as Layer 5 in Sample 1.

The thus prepared five kinds of samples were subjected to wedge exposure, developed with a conventional black-and-white developer containing Metol and hydroquinone as principal ingredients at 20° C. for one minute and 30 seconds, followed by the steps of stopping, fixing, water washing and drying. Then, sensitivities were determined by measurement of densities.

The results are shown in Table 1.

In the Table, the relative sensitivities are shown with the standard value of the sensitivity of Comparative sample (Sample 2) using no filter dye being 100. As apparently seen from Table 1, Sample 3 in which the colorant containing layer is provided on the side farther than the white pigment containing layer from the support is lowered to about ¼ in sensitivity, while Sample 1 according to the present invention exhibits only a very slight lowering of sensitivity.

On the other hand, the above three kinds of samples were exposed to light in contact with square wave charts having various space frequencies, followed by similar photographic treatments, for examination of sharpness. The sharpness was evaluated by CTF. CTF is determined by scanning the samples obtained by means of Sakura Microdensitometer (Model PDM-5, Type-AR, produced by Konishiroku Photo Industry Co.) and converting the density values measured to output energies from the characteristic curve, and represented in terms of CTF=(output energy contrast)-/(input energy contrast). Details of this method are disclosed in, for example, "Findamentals of Photographic Engineering, Part of Silver Salt Photography", p. 418 (edited by Photographic Society of Japan).

The results obtained are shown in Table 1 for space frequencies 5/mm lines, 10/mm lines and 20/mm lines.

TABLE 1

| Sample | Relative sensitivity | CTF 5 lines | CTF 10 lines | CTF 15 lines |
|---|---|---|---|---|
| 1 | 94 | 0.83 | 0.62 | 0.37 |
| 2 | 100 | 0.43 | 0.27 | 0.09 |
| 3 | 23 | 0.89 | 0.67 | 0.40 |
| 4 | 99 | 0.40 | 0.25 | 0.09 |
| 5 | 22 | 0.86 | 0.65 | 0.40 |

It can be seen from the results in Table 1 that Sample 1 according to the present invention has CTF values approximate to those of Sample 3, and it can be evaluated as particularly preferable light-sensitive material from the aspect of both sensitivity and sharpness. No such result will never be achieved by use of a conventional resin coated paper having dispersed a white pigment in polyethylene as the support.

When F-1 and F-4 were employed in place of F-6 as the filter dye, similar effects were obtained.

EXAMPLE 2

The following layers were provided by coating on a polyethyleneterephthalate support (thickness: 200μ) to prepare a multi-layer type light-sensitive silver halide color photographic material (Sample 6):

Layer 1: Colorant containing layer containing 0.12 g of black colloidal silver and 0.8 g of gelatin;

Layer 2: White pigment containing layer containing 2.2 g of gelatin having dispersed 25 g of anatase type titanium dioxide (the same as in Example 1) therein;

Layer 3: Intermediary layer containing 0.9 g of gelatin;

Layer 4: Blue-sensitive emulsion layer containing 1.6 g of gelatin, 0.42 g of blue-sensitive silver chlorobromide emulsion and 0.29 g of dioctylphthalate (DOP) coupler solvent containing 0.8 g of 2-(1-benzyl-2,4-dioxoimidazolidin-3-yl)-2-pivalyl-2'-chloro-5'-[4-(2,4-di-t-amylphenoxy)butaneamide]-acetanilide and 0.01 g of 2,5-di-t-octyl hydroquinone (OHQ) dissolved therein;

Layer 5: Intermediary layer containing 1.0 g of gelatin, 0.05 g of OHQ and 0.025 g of DOP;

Layer 6: Green-sensitive emulsion layer containing 1.7 g of gelatin, 0.4 g of green-sensitive silver chlorobromide, and 0.16 g of tricresyl phosphate coupler solvent containing 0.5 g of 1-(2,4,6-trichlorophenyl-3-[2-chloro-5-(1-octadicenylsuccinimido)-anilino]-5-pyrazolone and 0.015 g of OHQ dissolved therein;

Layer 7: Intermediary layer containing 1.5 g of gelatin and 0.04 g of DOP containing 0.08 g of OHQ dissolved therein;

Layer 8: Red-sensitive emulsion layer containing 1.6 g of gelatin, 0.3 g of red-sensitive silver chlorobromide emulsion and 0.19 g of DOP containing 0.35 g of 2-[2-(2,4-di-t-amylphenoxy)butaneamido]-4,6-dichloro-5-methylphenol and 0.01 g of OHQ dissolved therein;

Layer 9: Protective layer containing 0.9 g of gelatin.

Further, as comparative samples for Sample 6, the three kinds of samples shown below were also prepared at the same time.

(Comparative sample 7)

The same sample as Sample 6 except for using no black colloidal silver in Layer 1.

(Comparative sample 8)

The same sample as Sample 6 except that Layer 1 and Layer 2 were interchanged with each other.

(Comparative sample 9)

In Sample 7, each 10 mg of the following irradiation preventive dyes were added to Layer 6 and layer 8, respectively.

Irradiation preventive dye added to Layer 6:

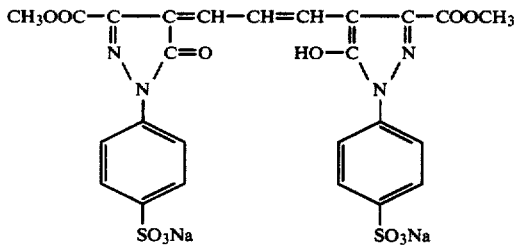

Irradiation preventive dye added to Layer 8:

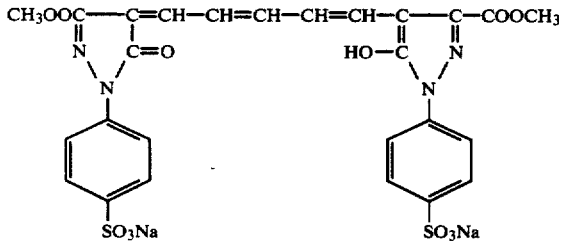

The four kinds of light-sensitive silver halide color photographic materials were subjected to white wedge exposure, followed subsequently by the photographic treatments in the order shown below at a temperature of 33° C.:

(Photographic treatment step):

Color forming development—3 minute 30 seconds
Bleaching fixation—1 minute 30 seconds
Washing with water—3 minutes The color forming developer and the bleaching fixer employed had the formulations shown below:

(Color forming developer formulation):

Pure water—800 ml
Benzyl alcohol—13 ml
N-ethyl-N-β-methanesulfonamideethyl-3-methyl-4-aminoaniline sulfate—4.9 g
Hydroxylamine—2.0 g
Potassium carbonate—25 g
Potassium bromide—0.5 g
Anhydrous sodium sulfite—2.0 g
Pure water was added to make up to one liter, and pH was adjusted to 10.2 with $H_2SO_4$ or NaOH (Bleaching fixer formulation):

Pure water—700 ml
Sodium ferric ethylenediaminetetraacetate—60 g
Ammonium thiosulfate—100 g
Sodium bisulfite—10 g
Sodium metabisulfite—3 g
Potassium bromide—5 g
Disodium ethylenediaminetetraacetate—10 g
Pure water was added to make up to one liter, and pH was adjusted to 7.0 with $H_2SO_4$ or aqueous ammonia.

The color images obtained were subjected to sensitometry with monochromatic lights of blue, green and red, respectively, to obtain the relative sensitivities as indicated in Table 2.

In the Table, the relative sensitivities are values relative to the sensitive of Sample 7 as 100, and B, G, R indicate that the density measurements were conducted with blue, green and red lights, respectively.

TABLE 2

| Sample | Relative sensitivity B | G | R |
|---|---|---|---|
| 6 | 95 | 96 | 96 |
| 7 | 100 | 100 | 100 |
| 8 | 31 | 26 | 24 |
| 9 | 59 | 42 | 53 |

On the other hand, exposure was effected on the above four kinds of samples with square wave charts similarly as in Example 1, and after similar photographic treatments, measurements were conducted by means of the microdensitometer to obtain CTF. In this case, exposure was effected through interference filters at 440 nm, 540 nm and 680 nm, respectively, and the measurements by the microdensitometer were also conducted with monochromatic lights coincident with the absorption of respective color formed dyes. CTF values at space frequencies of 5/mm lines and 10/mm lines are shown in Table 3.

TABLE 3

| Sample | B Lines 5 | B Lines 10 | G Lines 5 | G Lines 10 | R Lines 5 | R Lines 10 |
|---|---|---|---|---|---|---|
| 6 | 0.80 | 0.60 | 0.81 | 0.56 | 0.79 | 0.50 |
| 7 | 0.40 | 0.24 | 0.41 | 0.24 | 0.36 | 0.21 |
| 8 | 0.86 | 0.63 | 0.82 | 0.59 | 0.84 | 0.59 |
| 9 | 0.49 | 0.29 | 0.69 | 0.40 | 0.58 | 0.32 |

As apparently seen from Table 2 and Table 3, Sample 6 according to the present invention does not bring about lowering of sensitivity by the presence of a black colloidal silver and has a sharpness comparable to Sample 8 which has caused lowering of sensitivity to a great extent.

We claim:

1. A light-sensitive silver halide photographic element comprising a support having successively thereon a colorant containing layer, a white pigment containing layer and at least one silver halide emulsion layer; said colorant containing layer containing a colorant selected from the group consisting of a yellow colloidal silver, a grey colloidal silver, a blue colloidal silver and a filter dye, said colorant containing layer being capable of transmitting light in an amount of up to 50% and being capable of being made substantially colorless by a photographic treatment; said white pigment containing layer being permeable to a photographic treating solution and wherein the white pigment in said white pigment containing layer is present in an amount sufficient to maintain the white color of the pigment when viewing said element.

2. The light-sensitive silver halide photographic element according to claim 1, wherein the amount of light transmittance is up to 30%.

3. The light-sensitive silver halide photographic element according to claim 1, wherein said filter dye is an acidic dye containing sulfonyl groups or carboxyl groups.

4. The light-sensitive silver halide photographic element according to claim 3, wherein said acidic dye is selected from the group consisting of an azo type, a triphenylmethane type, an anthraquinone type, a styryl type, a benzylidene type, a melocyanine type and an oxonol type dye.

5. The light-sensitive silver halide photographic element according to claim 4, wherein said acidic dye is selected from the group consisting of the compounds (F-1) to (F-15) represented by the following formulas:

(F-1)

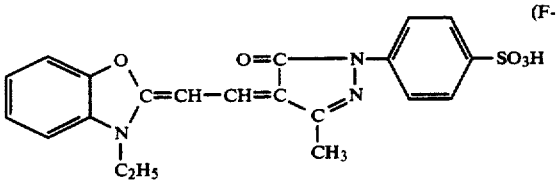

(F-2)

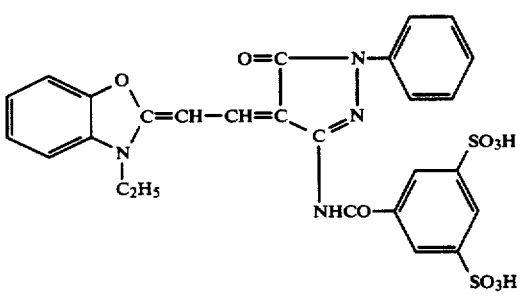

(F-3)

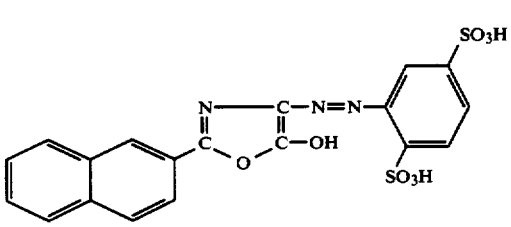

(F-4)

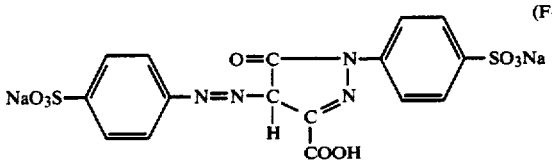

-continued (F-5)

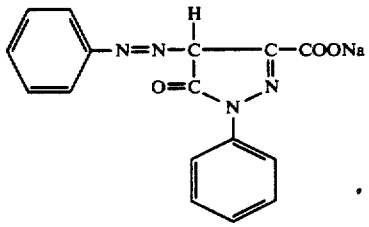

(F-6)

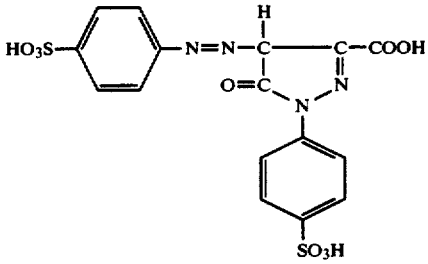

(F-7)

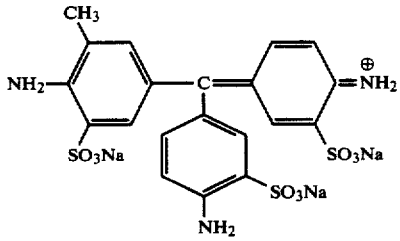

(F-8)

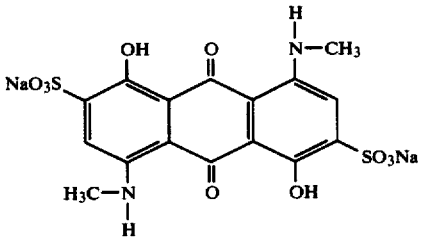

(F-9)

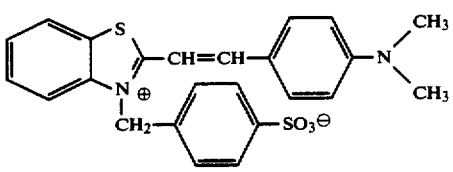

(F-10)

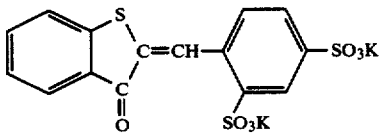

(F-11)

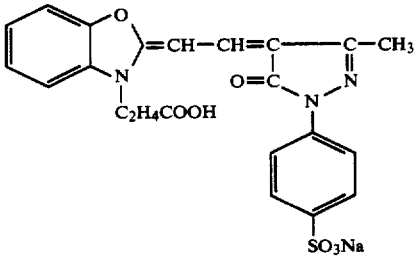

-continued

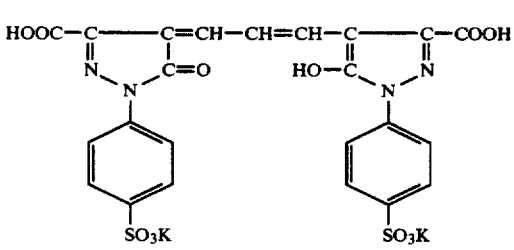

(F-12)

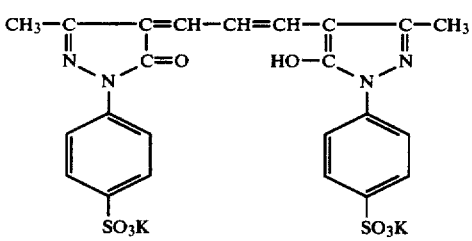

(F-13)

-continued

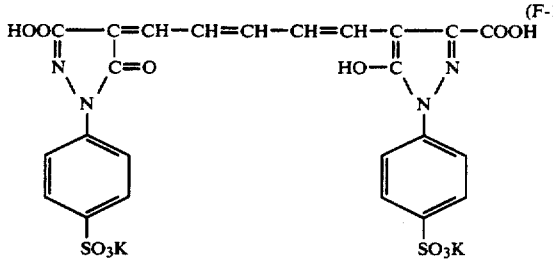

(F-14)

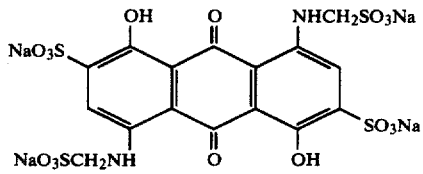

(F-15)

6. The light-sensitive silver halide photographic element according to claim 1, wherein said filter dye is used in combination with a mordant.

7. The light sensitive silver halide photographic element according to claim 6, wherein said mordant is a macromolecular mordant having basic groups selected from imidazolyl, pyridyl, alkylaminoalkyl, quarternary salts thereof and aminoguanidyl groups.

8. The light-sensitive silver halide photographic element according to claim 1, wherein said white pigment is selected from titanium dioxide, barium sulfate, zinc oxide, barium stearate, silica, alumina, zirconium oxide and kaolin.

9. The light-sensitive silver halide photographic element according to claim 8, wherein said white pigment is titanium dioxide.

10. The light-sensitive silver halide photographic element according to claim 9, wherein said support is a transparent base and said titanium dioxide is present in an amount of from 10 to 50 g/m$^2$.

* * * * *